US008950077B2

(12) United States Patent
Quimby et al.

(10) Patent No.: US 8,950,077 B2
(45) Date of Patent: Feb. 10, 2015

(54) UTILITY KNIFE APPARATUS WITH BLADES HAVING MULTIPLE CUTTING PORTIONS

(71) Applicants: Elwood Dean Quimby, Derby, KS (US); Hubert J. Bung, Wichita, KS (US); Jeremy E. Weinman, Derby, KS (US)

(72) Inventors: Elwood Dean Quimby, Derby, KS (US); Hubert J. Bung, Wichita, KS (US); Jeremy E. Weinman, Derby, KS (US)

( * ) Notice: Subject to any disclaimer, the term of this patent is extended or adjusted under 35 U.S.C. 154(b) by 0 days.

(21) Appl. No.: 13/971,633

(22) Filed: Aug. 20, 2013

(65) Prior Publication Data

US 2013/0333230 A1 Dec. 19, 2013

Related U.S. Application Data

(63) Continuation-in-part of application No. 13/199,206, filed on Aug. 23, 2011, now abandoned.

(60) Provisional application No. 61/742,836, filed on Aug. 20, 2012, provisional application No. 61/402,536, filed on Sep. 1, 2010.

(51) Int. Cl.
*B26B 5/00* (2006.01)
*B26B 9/00* (2006.01)

(52) U.S. Cl.
CPC .... *B26B 5/00* (2013.01); *B26B 9/00* (2013.01)
USPC ..... 30/330; 30/329; 30/331; 30/125

(58) Field of Classification Search
USPC ..... 30/153–156, 161, 2, 329–331, 125
See application file for complete search history.

(56) References Cited

U.S. PATENT DOCUMENTS

| | | | |
|---|---|---|---|
| 59,770 | A | 11/1866 | Jann |
| 394,349 | A | 12/1888 | Elliot |
| 639,850 | A | 12/1899 | Hahn |
| 670,120 | A | 3/1901 | Van Tuyl |
| 978,165 | A | 12/1910 | Johnson |
| D47,697 | S | 8/1915 | Korpa |
| D47,778 | S | 8/1915 | Yapczenski |
| 1,176,257 | A | 3/1916 | Velcansky |
| 1,278,682 | A | 9/1918 | Kohnz |
| 1,600,126 | A | 9/1926 | Myatt |
| 1,739,214 | A | 12/1929 | Darling |
| 1,814,528 | A | 7/1931 | Purcell |

(Continued)

FOREIGN PATENT DOCUMENTS

| | | |
|---|---|---|
| FR | 2571486 | 4/1986 |
| FR | 2629578 | 10/1989 |

(Continued)

*Primary Examiner* — Jason Daniel Prone

(74) *Attorney, Agent, or Firm* — Law Office of Mark Brown, LLC; Christopher M. DeBacker; Mark E. Brown

(57) ABSTRACT

A utility knife employing a blade having multiple cutting portions, and a housing for quickly and simply swapping out one cutting portion for another. In a preferred embodiment, a six-cutting-portion featured blade is employed. Each point of the six-cutting-portion featured blade features two distinct cutting portions, for a total of six cutting portions located on a single blade. The blade can be rotated about a central axis to expose new cutting portions as old portions wear and dull. In another embodiment, a single-edged blade featuring two cutting faces is housed in a knife handle. The blade can be flipped when the first edge is dull or worn to expose a second cutting face. The handle may optionally include a storage space for storing additional blades.

5 Claims, 16 Drawing Sheets

(56) References Cited

U.S. PATENT DOCUMENTS 1,829,499 A 10/1931 Boos
1,850,090 A 3/1932 Alexander et al.
1,872,721 A 8/1932 Ford
1,903,789 A 4/1933 Michaels
1,940,107 A 12/1933 Stichler
2,003,761 A 6/1935 Testi
2,036,057 A 3/1936 Kulisek
2,041,778 A 5/1936 Peters
2,070,190 A 2/1937 Wells
2,126,080 A 8/1938 Backer
2,248,796 A 7/1941 Vosbikian et al.
2,324,555 A 7/1943 Blunk
2,365,301 A 12/1944 Shortell
2,382,440 A 8/1945 Peterson
2,443,873 A 6/1948 Simpson
2,520,463 A 8/1950 Hubner
2,542,582 A 2/1951 Schwork
2,551,899 A 5/1951 Pfeifer et al.
2,557,539 A 6/1951 Dawson
2,587,336 A 2/1952 Larson
2,631,372 A 3/1953 Fournier
2,650,442 A 9/1953 Soltow et al.
2,662,287 A 12/1953 Ferguson
2,681,506 A 6/1954 Tipple
2,732,620 A 1/1956 Gibbs
2,835,031 A 5/1958 Cook et al.
2,863,213 A 12/1958 Rypysc
2,962,816 A 12/1960 Glotzer
3,037,342 A 6/1962 Boyer
3,045,348 A 7/1962 Dungan
3,448,518 A 6/1969 Sklar
3,518,758 A 7/1970 Bennet
3,600,729 A 8/1971 Laughlin et al.
3,641,667 A * 2/1972 Leopoldi ..... 30/161
3,872,591 A * 3/1975 Quenot ..... 30/162
4,027,389 A 6/1977 Atchisson
4,077,124 A 3/1978 Christmann
4,288,921 A 9/1981 Rhynes
4,502,219 A 3/1985 Hibben
4,504,091 A 3/1985 Ohshiro
4,534,110 A 8/1985 Glass
4,592,113 A 6/1986 Selfors
4,606,125 A 8/1986 Jensen
4,730,394 A 3/1988 Sonner
4,745,653 A 5/1988 Bliznak
4,787,146 A 11/1988 Gaskins
4,807,362 A 2/1989 Prentice
4,856,385 A 8/1989 Ogilvie et al.
4,886,009 A 12/1989 Gondar et al.
5,003,696 A 4/1991 Spehar
5,081,770 A 1/1992 Fierthaler
5,103,564 A 4/1992 MacDonald
5,303,474 A 4/1994 Keklak et al.
5,303,574 A 4/1994 Matossian et al.
5,349,753 A * 9/1994 Gaffney ..... 30/155
5,400,512 A 3/1995 Brush
5,440,811 A 8/1995 Challis
5,446,965 A 9/1995 Makridis
5,557,852 A 9/1996 Frisina
5,636,845 A 6/1997 Newham
5,720,105 A 2/1998 Gates
5,769,094 A * 6/1998 Jenkins et al. ..... 30/161
D400,412 S 11/1998 Gold
5,960,545 A 10/1999 Sheperd et al.
6,134,788 A * 10/2000 Chen et al. ..... 30/161
6,163,965 A 12/2000 Lung
6,192,589 B1 * 2/2001 Martone et al. ..... 30/162
6,243,952 B1 6/2001 Holcomb et al.
6,314,646 B1 11/2001 Schmidt
6,321,454 B1 11/2001 Wass
D462,250 S 9/2002 Ping
6,446,341 B1 * 9/2002 Wang et al. ..... 30/161
6,454,427 B1 * 9/2002 Chen ..... 30/125
6,460,254 B1 10/2002 Mori et al.
6,497,045 B1 12/2002 Forgami
6,711,824 B2 3/2004 Hruska
6,796,033 B2 9/2004 Owoc
6,823,593 B2 11/2004 Dunn-Rankin
6,848,185 B2 2/2005 Tebo
6,887,250 B1 5/2005 Dority et al.
6,895,674 B2 5/2005 Ai
D510,009 S 9/2005 Lee
6,968,622 B2 * 11/2005 Ping ..... 30/156
6,976,311 B2 12/2005 Lee
7,093,367 B1 8/2006 Huang
7,255,705 B2 8/2007 Hsu et al.
7,380,341 B2 * 6/2008 Ping ..... 30/161
D580,241 S 11/2008 Fraga et al.
7,480,997 B2 * 1/2009 Ping ..... 30/161
7,552,537 B2 * 6/2009 Ye ..... 30/161
D602,752 S 10/2009 Luciano et al.
D617,161 S 6/2010 Tom et al.
D617,162 S 6/2010 Tom et al.
D619,865 S 7/2010 Boehler
7,797,835 B2 * 9/2010 Zeng ..... 30/153
7,921,568 B2 4/2011 Green
8,006,391 B1 8/2011 Mashburn et al.
8,056,241 B2 11/2011 David et al.
8,074,362 B2 * 12/2011 Gui et al. ..... 30/156
D686,481 S * 7/2013 Robinson et al. ..... D8/99
8,549,754 B2 * 10/2013 Bung et al. ..... 30/161
8,567,069 B2 * 10/2013 Robinson et al. ..... 30/161
8,739,412 B2 6/2014 Gioia
8,776,380 B1 7/2014 Quimby et al.
2003/0177645 A1 9/2003 Flury et al.
2003/0200853 A1 10/2003 Gongola
2004/0055165 A1 3/2004 Chan
2004/0103541 A1 * 6/2004 Scarla ..... 30/161
2004/0231169 A1 11/2004 Roberson
2006/0272157 A1 * 12/2006 Zeng ..... 30/161
2008/0264227 A1 10/2008 Sudmalis et al.
2009/0165309 A1 * 7/2009 Kamb et al. ..... 30/161
2009/0211421 A1 8/2009 Lier et al.
2010/0175267 A1 * 7/2010 Seber et al. ..... 30/156
2010/0299935 A1 * 12/2010 Ping ..... 30/161
2011/0167647 A1 * 7/2011 Gringer et al. ..... 30/156
2012/0055029 A1 * 3/2012 Gui et al. ..... 30/156
2012/0079722 A1 * 4/2012 Quimby et al. ..... 30/165
2012/0240413 A1 9/2012 Quimby et al.
2013/0047447 A1 2/2013 Fossella
2013/0185943 A1 * 7/2013 Landwehr ..... 30/153
2013/0333230 A1 12/2013 Quimby et al.
2014/0068951 A1 * 3/2014 Quimby et al. ..... 30/320
2014/0182144 A1 * 7/2014 Quimby et al. ..... 30/351
2014/0208594 A1 * 7/2014 Scimone et al. ..... 30/2
2014/0259686 A1 * 9/2014 Garavaglia et al. ..... 30/156

FOREIGN PATENT DOCUMENTS

FR 2634874 2/1990
FR 2682062 4/1993

* cited by examiner

UTILITY KNIFE APPARATUS WITH BLADES HAVING MULTIPLE CUTTING PORTIONS

CROSS-REFERENCES TO RELATED APPLICATIONS

This application claims priority in U.S. Provisional Patent Application No. 61/742,836, filed Aug. 20, 2012, and is a continuation-in-part of and claims priority in U.S. patent application Ser. No. 13/199,206, filed Aug. 23, 2011, which claims priority in U.S. Provisional Patent Application No. 61/402,536, filed Sep. 1, 2010, all of which are incorporated herein by reference.

BACKGROUND OF THE INVENTION

1. Field of the Invention

This application relates to utility knife blades, and more particularly, to unconventional utility knife blades with six defined individual cutting portions that allow the user to have available on one blade, six individual cutting portions that will be used with special designed utility knives.

2. Background and Description of the Related Art

Conventional disposable utility blades are well known in the art. These blades, along with their knives, have many industrial as well as home uses, such as for opening boxes, cutting cord or cutting wallboard. Typical utility blades are encased in a plastic or metal handle in either a fixed or retractable position. When in use, the blade is positioned to extend outwardly from the handle, exposing the cutting edge and one of the cutting portions of the blade.

Utility knife blades come in a variety of shapes depending upon the intended use. A conventional utility blade has a generally trapezoidal shape that includes a back edge, a cutting edge and two side edges. The trapezoidal shaped blades have two cutting edges or tips formed at the intersections between the side edges and the cutting edge. These sharp points or tips enable a user to puncture through a material which is desired to be cut, such as sealing tape or the cardboard box. Once the object has been punctured and penetrated, the user can slice open the material by dragging the knife along the surface of the material allowing the cutting edge to cut through the material.

Existing prior art includes U.S. Pat. Nos. 7,921,568; 5,557,852; 2,542,582; 4,592,113; 3,037,342; 5,636,845; and 4,745,653.

Although trapezoidal-shaped utility blades are widely used, they have only two usable cutting edges. They have the disadvantage that when the two edges get dull, the blade has to be replaced. The two-edged blade, therefore, requires more frequent replacement after the two cutting edges are worn out.

Break-off style blades with a multitude of cutting edges are not well suited for many applications and there is a greater safety or injury risk due to potential snap-off during usage when side loads are applied.

There is a need for an improved utility knife blade that overcomes one or more of the above-described drawbacks and/or disadvantages of conventional prior art utility knife blades.

SUMMARY OF THE INVENTION

The present invention provides a utility knife employing a blade having multiple cutting edges, and a means for quickly and simply swapping out one cutting edge for another.

In a preferred embodiment, six-cutting-edge featured blade is employed. Each point of the generally triangular-shaped, six-cutting portion featured blade features two distinct cutting portions, for a total of six cutting portions located on a single blade. The blade can be rotated about a central axis to expose new cutting portions as old edges wear and dull.

In another embodiment, a single-edged blade featuring two cutting faces is housed in a knife handle. The blade can be flipped when the first edge is dull or worn to expose a second cutting face. The handle may optionally include a storage space for storing additional blades.

Other aspects and advantages of the present invention will become more readily apparent in view of the following detailed description and accompanying drawings.

DETAILED DESCRIPTION OF THE PREFERRED EMBODIMENTS

I. Introduction and Environment

Figure 1:
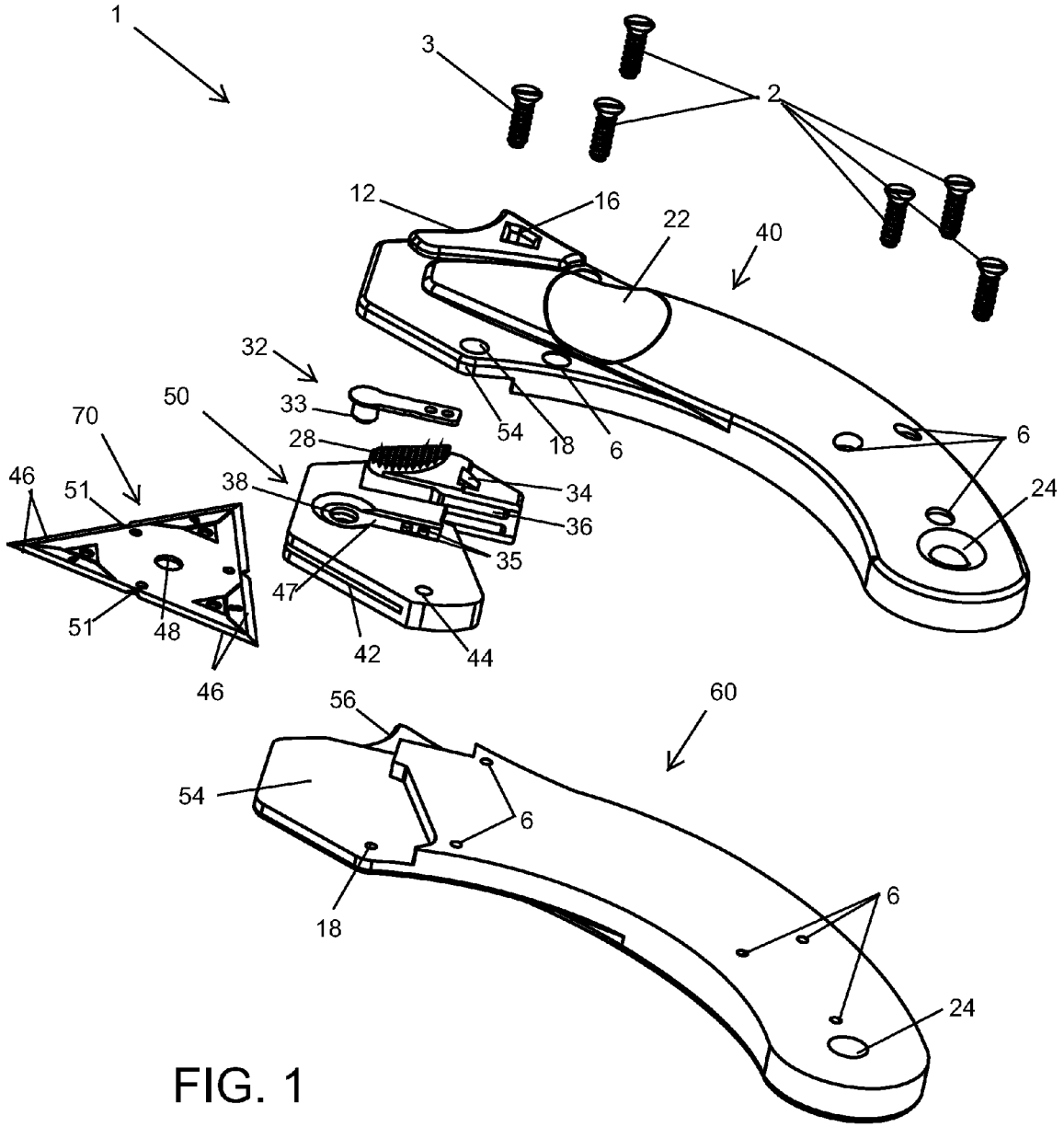
FIG. 1 is an exploded isometric view of an embodiment of the present invention featuring a blade having six cutting faces.
Figure 2:
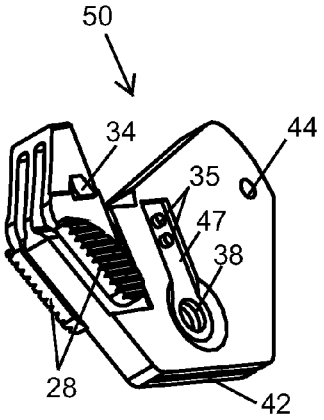
FIG. 2 is an isometric view of a blade holder element of said embodiment.
Figure 3:
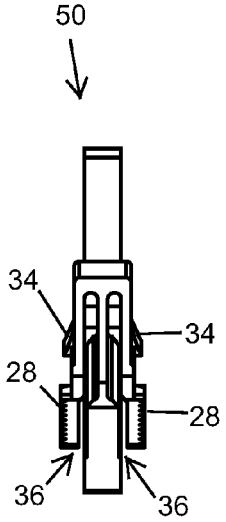
FIG. 3 is a front elevational view thereof.
Figure 4:
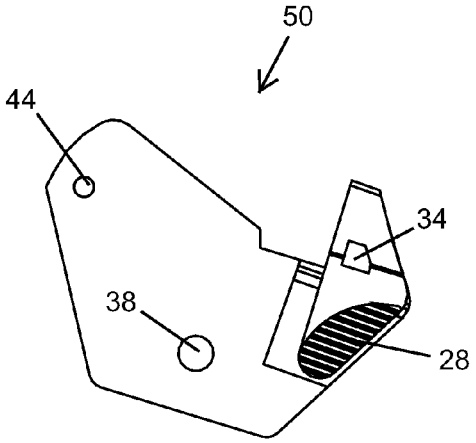
FIG. 4 is a side elevational view thereof.
Figure 5:
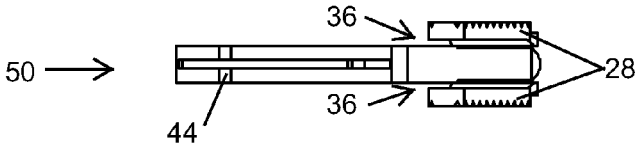
FIG. 5 is a top plan view thereof.
Figure 6:
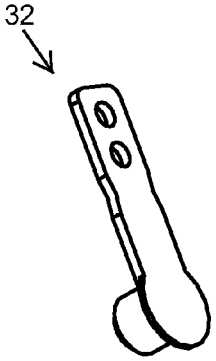
FIG. 6 is an isometric view of a locking pin button element of said embodiment.
Figure 7:
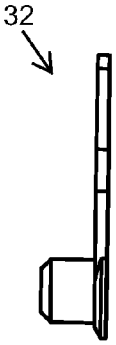
FIG. 7 is a side elevational view thereof.
Figure 8:
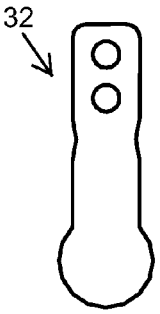
FIG. 8 is a rear elevational view thereof.
Figure 9:
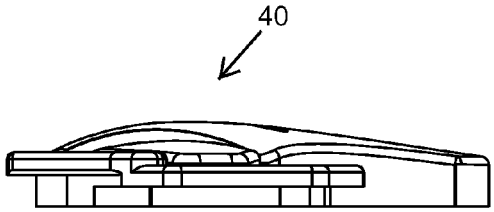
FIG. 9 is a top plan view of a right hand half of a knife handle element of said embodiment.
Figure 10:
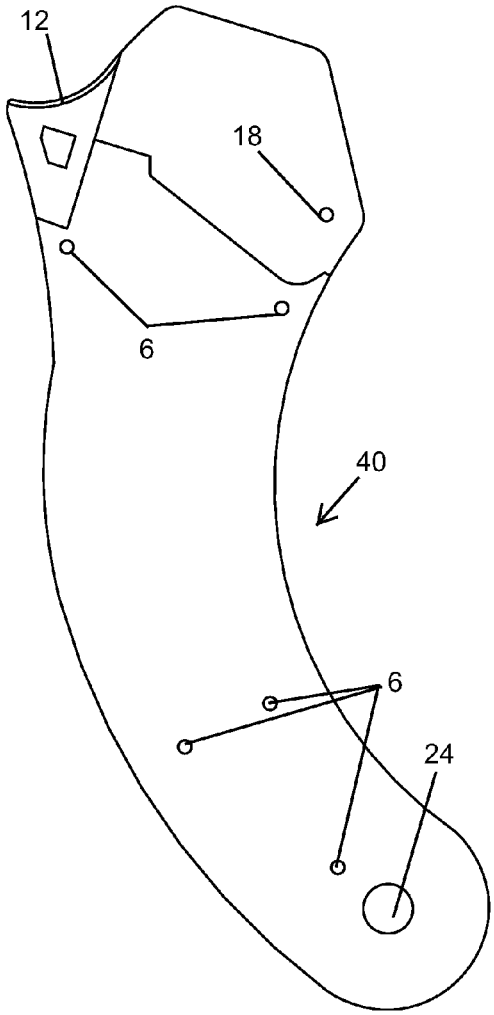
FIG. 10 is a rear elevational view thereof.
Figure 11:
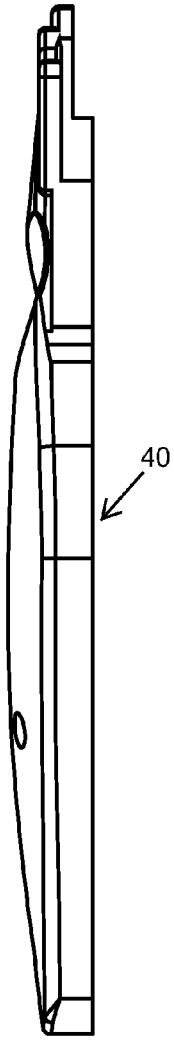
FIG. 11 is a side elevational view thereof.
Figure 12:
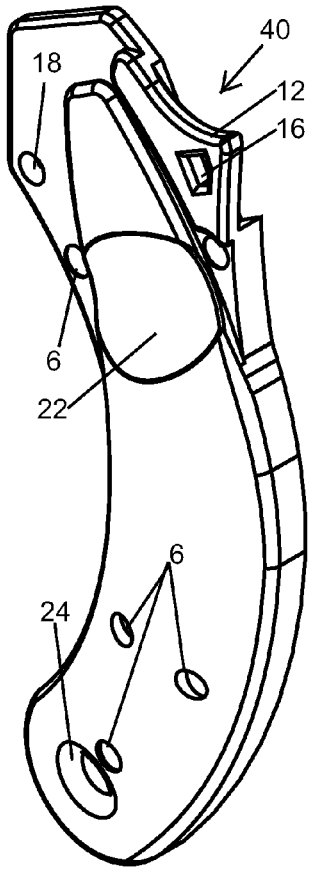
FIG. 12 is an isometric view thereof.
Figure 13:
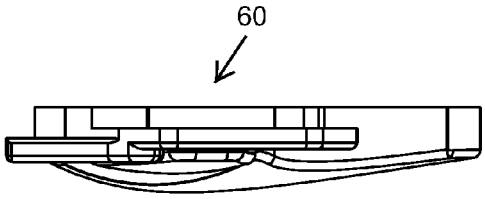
FIG. 13 is a top plan view of a left hand half of a knife handle element of said embodiment.
Figure 14:
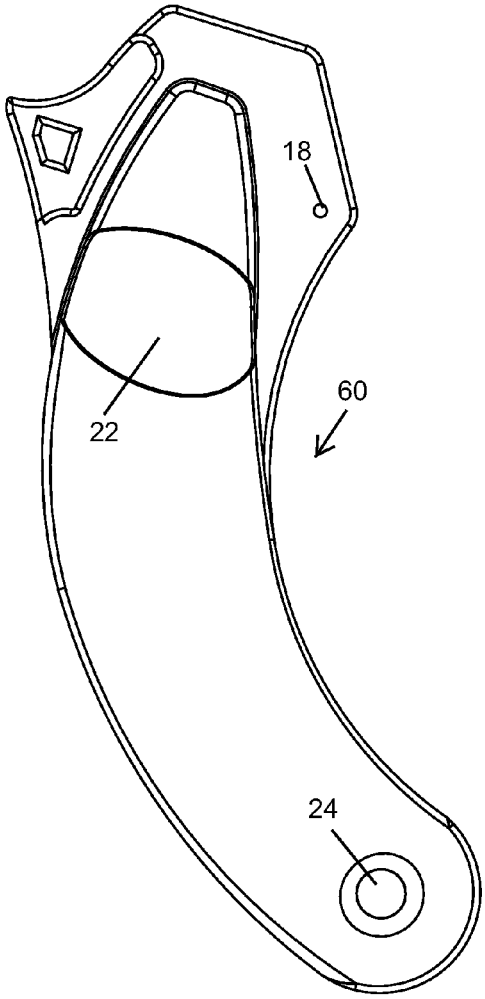
FIG. 14 is a rear elevational view thereof.
Figure 15:
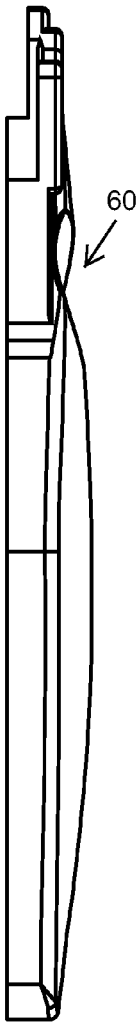
FIG. 15 is a side elevational view thereof.
Figure 16:
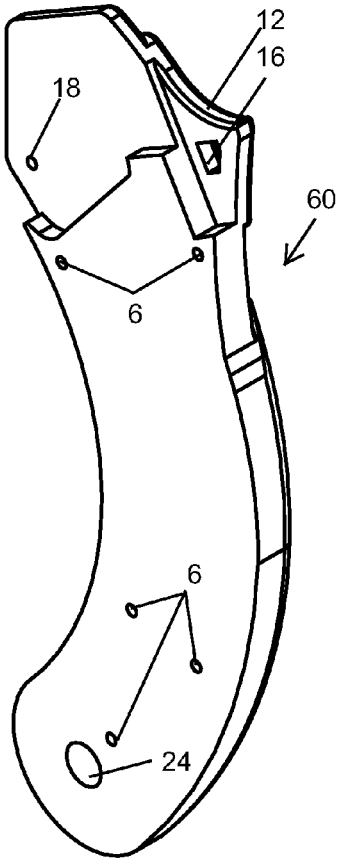
FIG. 16 is an isometric view thereof.
Figure 17A:
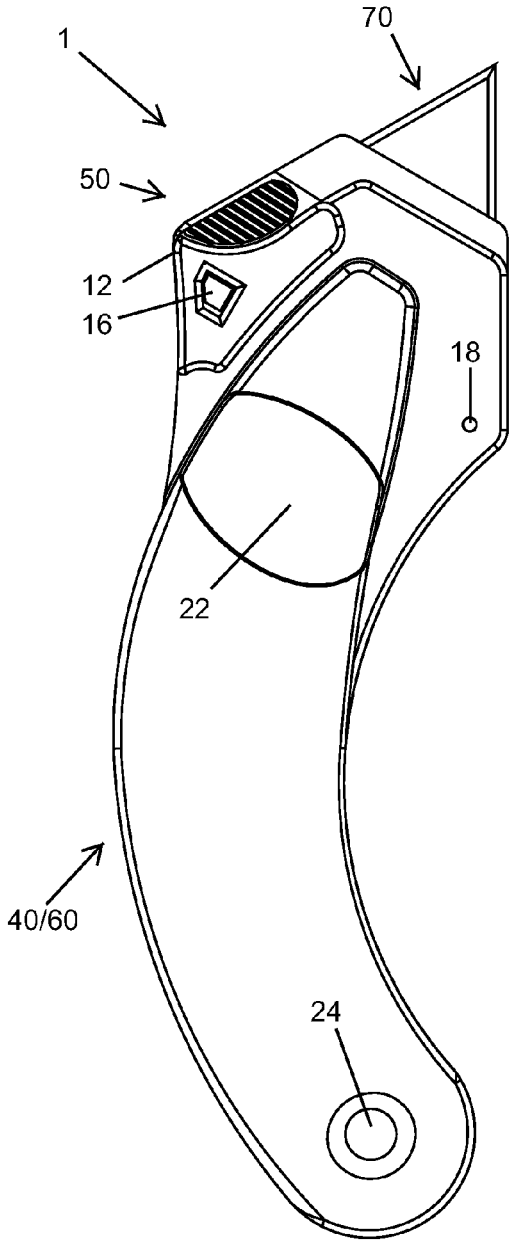
FIG. 17A is a side elevational view of a knife embodying said invention.
Figure 17B:
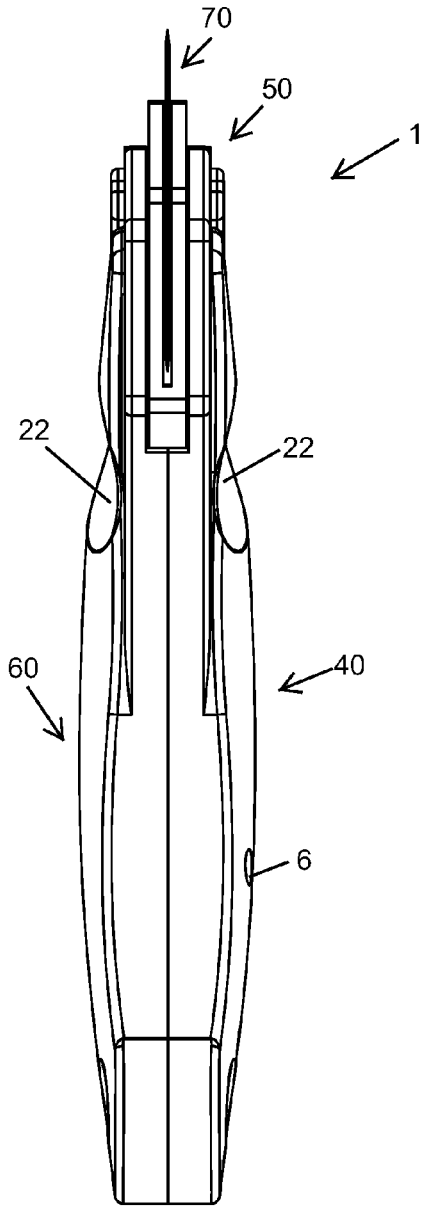
FIG. 17B is a front elevational view thereof.

As required, detailed aspects of the disclosed subject matter are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, base, front, back, right and left refer to the invention as oriented in the view being referred to. The words "inwardly" and "outwardly" refer to directions toward and away from, respectively, the geometric center of the embodiment being described and designated parts thereof. Forwardly and rearwardly are generally in reference to the direction of travel, if appropriate. Said terminology will include the words specifically mentioned, derivatives thereof and words of similar meaning.

A preferred embodiment features a knife blade body capable of allowing a knife blade to rotate or turn, thereby exposing additional cutting surfaces for use.

II. Preferred Embodiment Utility Knife Apparatus 1

As shown in FIGS. 1-18, a preferred embodiment of the present invention includes a knife handle comprising a right portion 40 and a left portion 60, a six-cutting portion featured knife blade 70, a blade receiving head 50 for holding the blade in place, and a locking button pin 32 for locking the blade 70 into the blade receiving head 50. A number of securing or mounting bolts 2 are used to join the various elements together, including joining the right handle portion 40 to the left handle portion 60 through a variety of mounting bolt holes 6. A pivot bolt 3 inserted through a pivot bolt hole 18 of the handle portions pivotally mounts the blade receiving head 50 to the handle.

Each handle portion 40, 60 includes a recess 22 for providing grip control when using the knife. A hook area 12 is located along the top edge of each handle portion, the hook area including a locking notch 16 which engages with the latching catch 34 located on the blade receiving head 50, thereby locking the head in place between the two handle portions. The handle portions also include a knife hanging hole 24 which would allow a string or other structure to be looped through the hole for easy storage or transport of the assembled knife 1. Each handle portion 40, 60 includes a recess 54 for receiving the blade receiving head 50, and a recess 56 for receiving the flexible finger grip 28 which allows for the release of the latching catch 34, which thereby allows the receiving head 50 to pivot about the pivot bolt 3.

The blade receiving head 50 also includes a pivot hole 44 for receiving the pivot bolt 3 after passing through the right handle portion 40 pivot hole 18. This pivotally engages the blade receiving head with the handle portions. The blade 70 is inserted into a blade slot 42 located in the blade receiving head 50. The locking button pin 32 locks the blade in place within a recess area 47 located on the blade receiving head by inserting the button 33 through the blade retaining hole 48 located in the blade, and the blade retaining hole 38 located in the opposite side of the blade retaining head 50. To switch which blade edge is active, the blade can be removed, flipped and turned, and reinserted to present a new blade. The locking button pin 32 is further secured in place to the blade receiving head by a pair of pegs 35 located on the top face of the blade receiving head.

The blade receiving head 50 also includes a flex area 36 which allows inward movement of a finger squeeze grip element 28 which ultimately releases the latch catch 34 from the knife handle portions 40, 60 when the knife is assembled, thereby allowing the head to rotate away from the handle such that the blade can be turned or flipped, thereby presenting a new cutting portion.

Figure 18A:
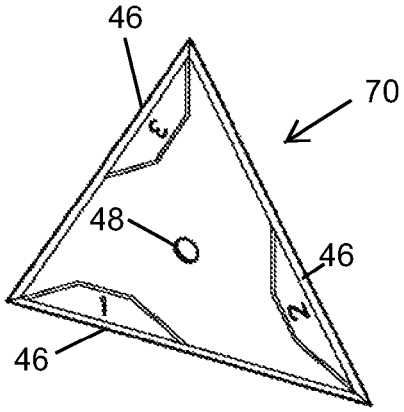
FIG. 18A is an isometric view of a three-sided blade.
Figure 18B:
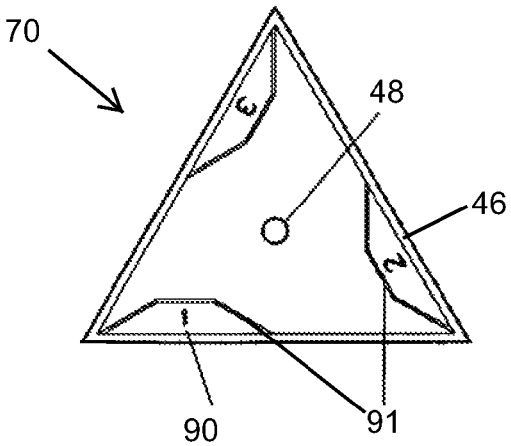
FIG. 18B is a front elevational view thereof.
Figure 18C:
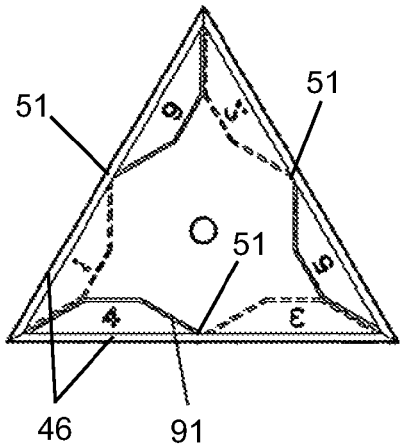
FIG. 18C is a rear elevational view thereof, showing the blade edges located on the front face in hidden lines.
Figure 18D:
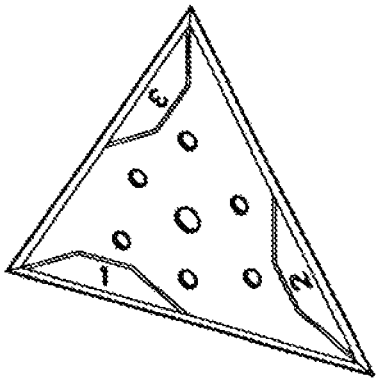
FIG. 18D is an isometric view of a three-sided blade of an alternative configuration.
Figure 18E:
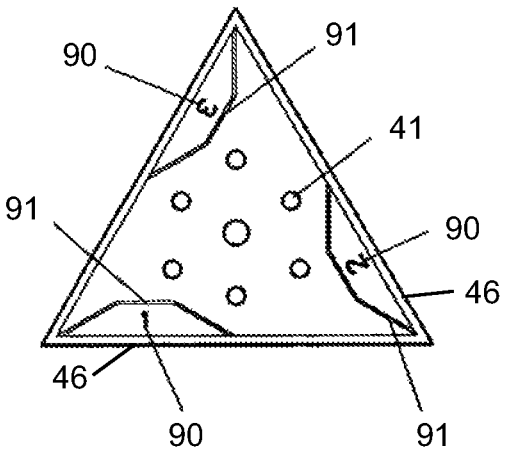
FIG. 18E is a front elevational view thereof.
Figure 18F:
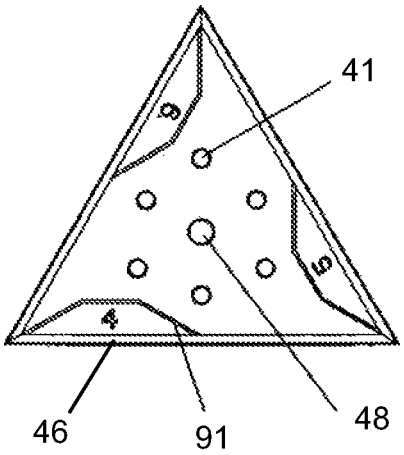
FIG. 18F is a rear elevational view thereof.
Figure 18G:
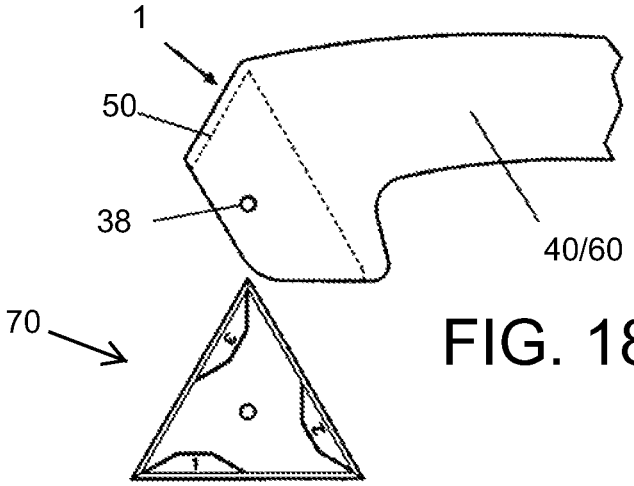
FIG. 18G is a side elevational view of a three-sided blade being fitted into a simplified knife handle and blade receiver head.
Figure 18H:
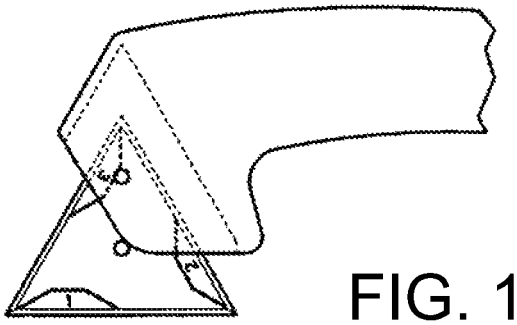
FIG. 18H is a second step in a series thereof.
Figure 18I:
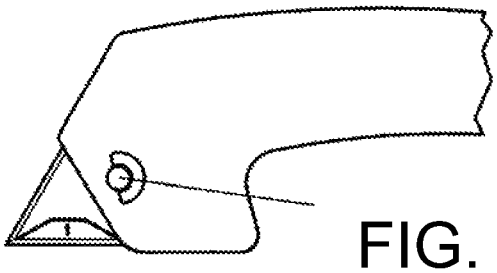
FIG. 18I is a third step in a series thereof.
Figure 18J:
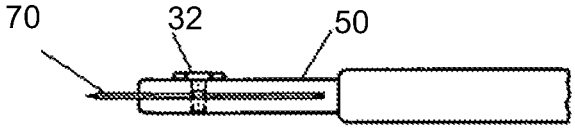
FIG. 18J is a top plan view thereof.
Figure 18K:
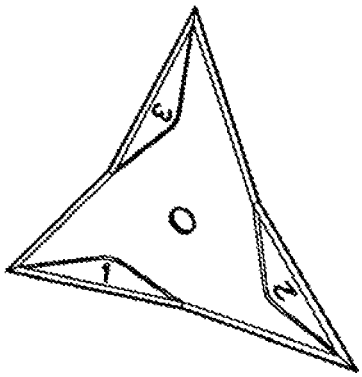
FIG. 18K is an isometric view of a three-sided blade of an alternative configuration.
Figure 18L:
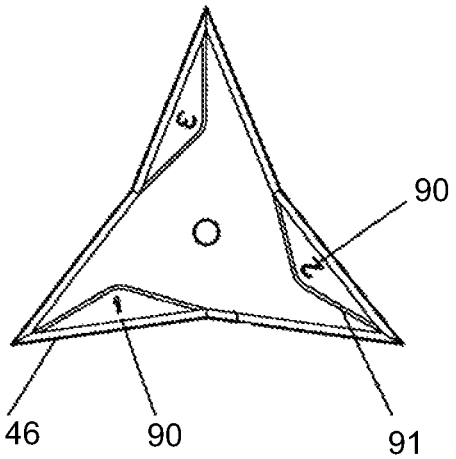
FIG. 18L is a front elevational view thereof.
Figure 18M:
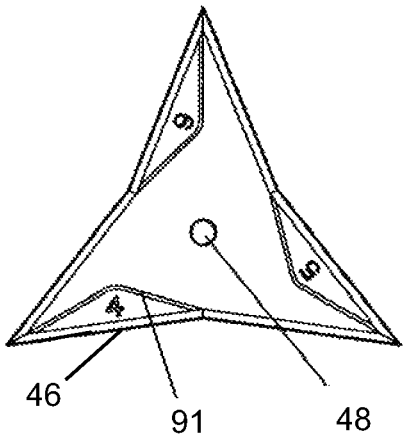
FIG. 18M is a rear elevational view thereof.
Figure 19:
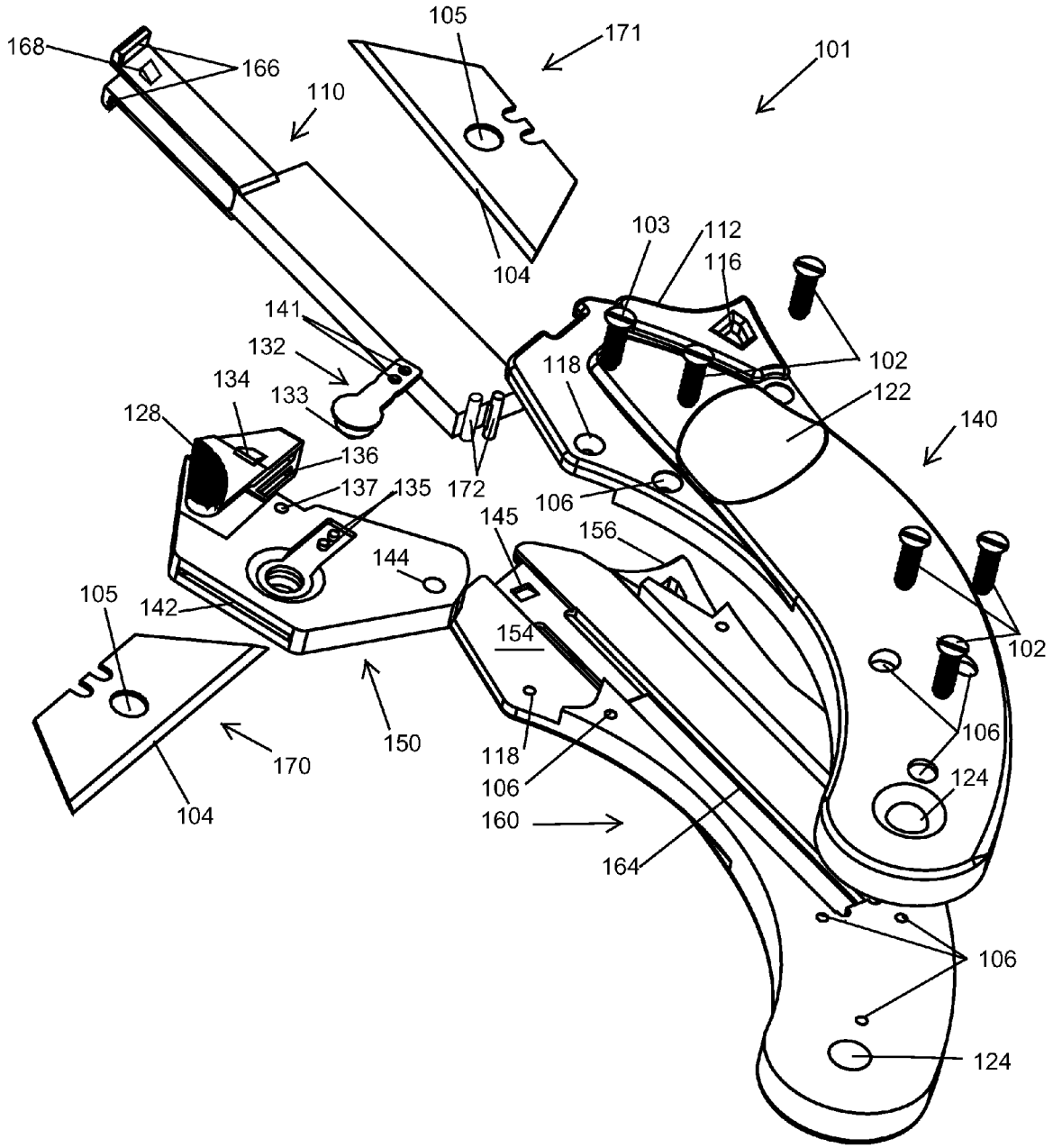
FIG. 19 is an exploded isometric view of an alternative embodiment of the present invention featuring a single-edged blade having two cutting faces.
Figure 20:
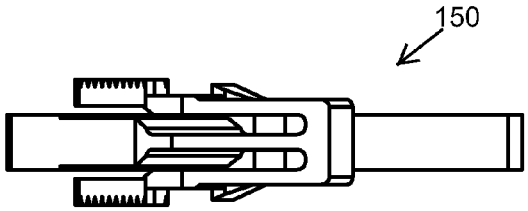
FIG. 20 is a top plan view of a blade holder element of said alternative embodiment.
Figure 21:
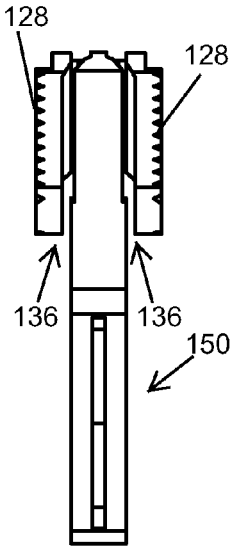
FIG. 21 is a front elevational view thereof.
Figure 22:
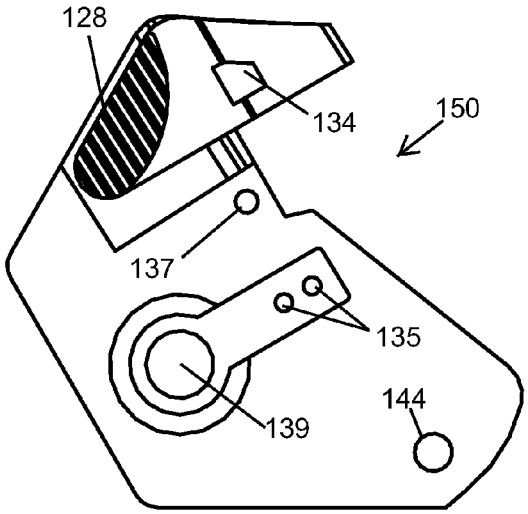
FIG. 22 is a side elevational view thereof.
Figure 23:
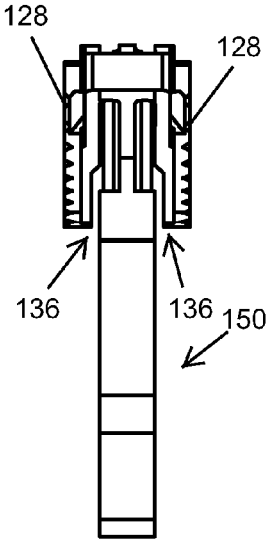
FIG. 23 is a rear elevational view thereof.
Figure 24:
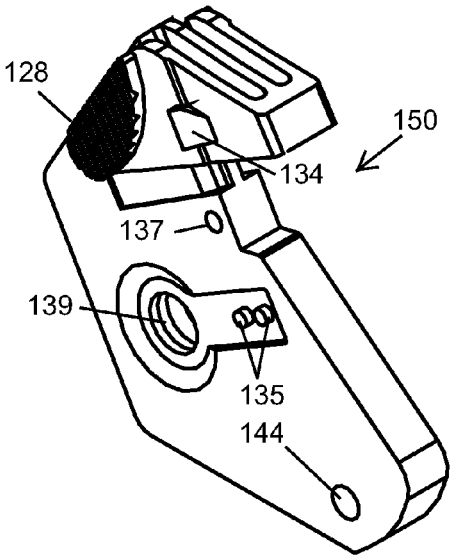
FIG. 24 is an isometric view thereof.
Figure 25:
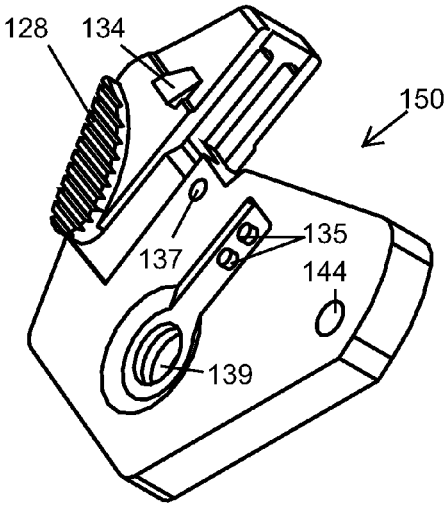
FIG. 25 is an alternative isometric view thereof.
Figure 26:
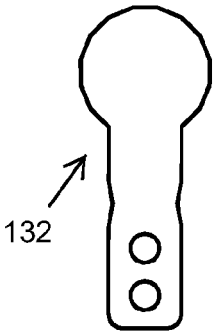
FIG. 26 is a rear elevational view of a locking pin button element of said alternative embodiment.
Figure 27:
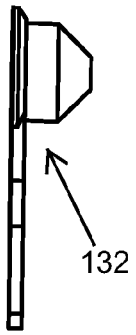
FIG. 27 is a side elevational view thereof.
Figure 28:
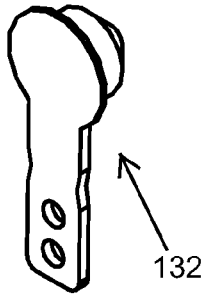
FIG. 28 is an isometric view thereof.
Figure 29:
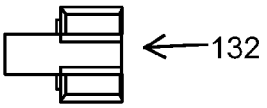
FIG. 29 is a top plan view of a blade magazine clip element for said alternative embodiment.
Figure 30:
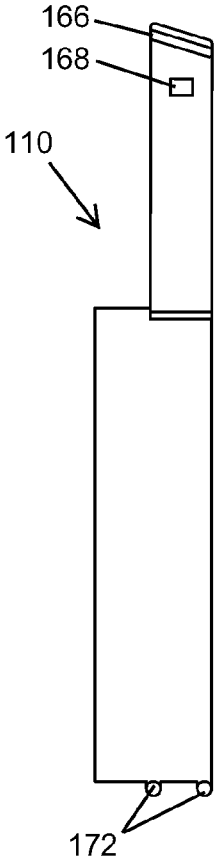
FIG. 30 is a side elevational view thereof.
Figure 31:
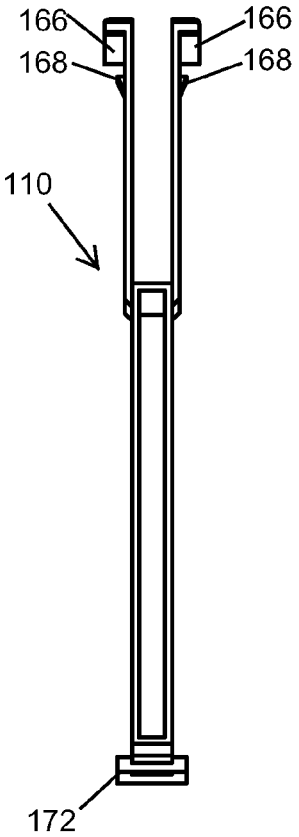
FIG. 31 is a front elevational view thereof.
Figure 32:
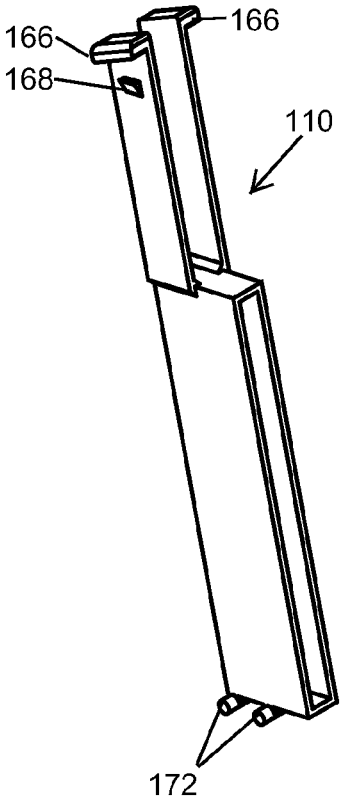
FIG. 32 is an isometric view thereof.
Figure 33:
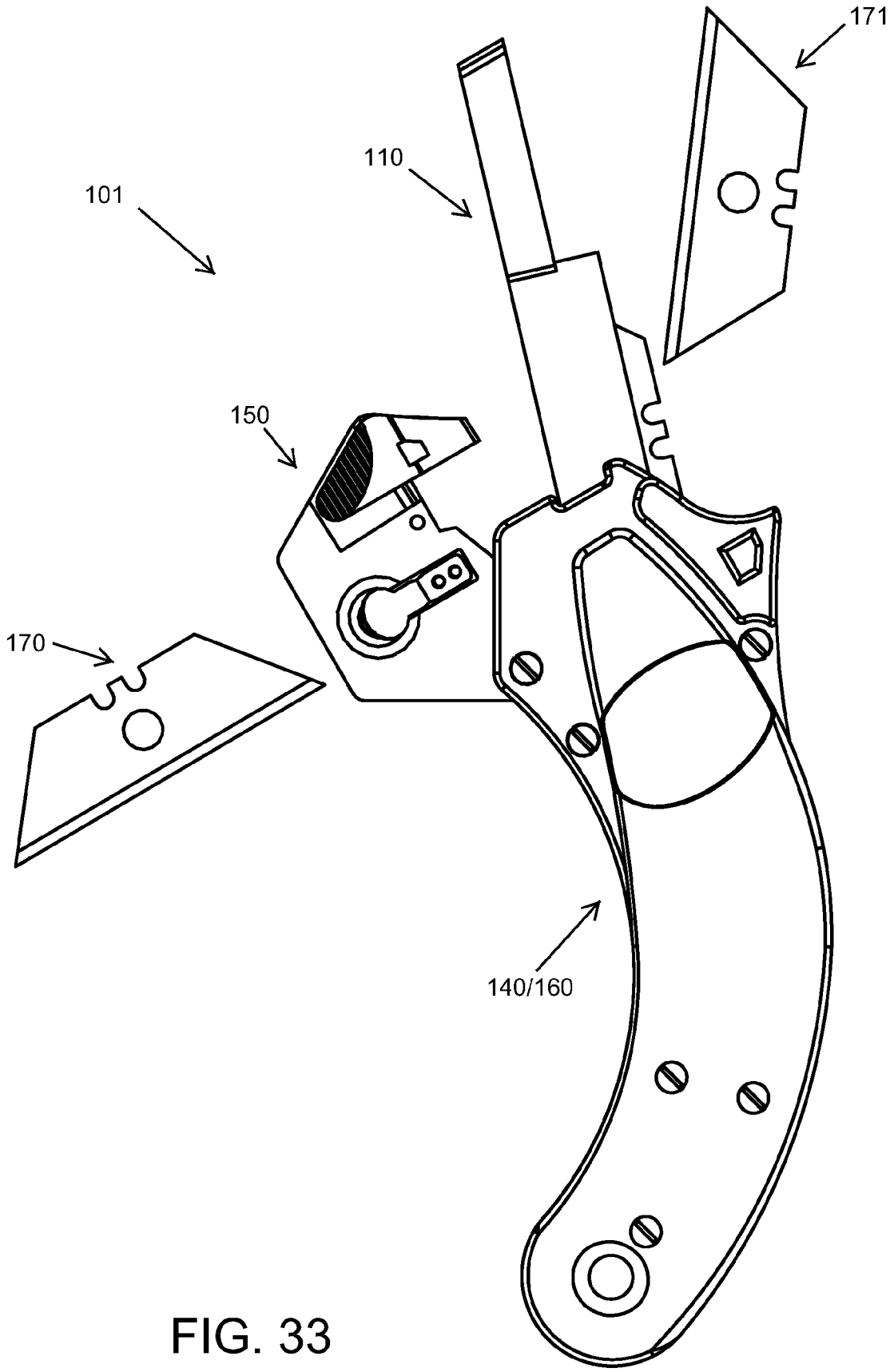
FIG. 33 is a side elevational view of a knife embodying said alternative embodiment, shown in a disassembled position.
Figure 34:
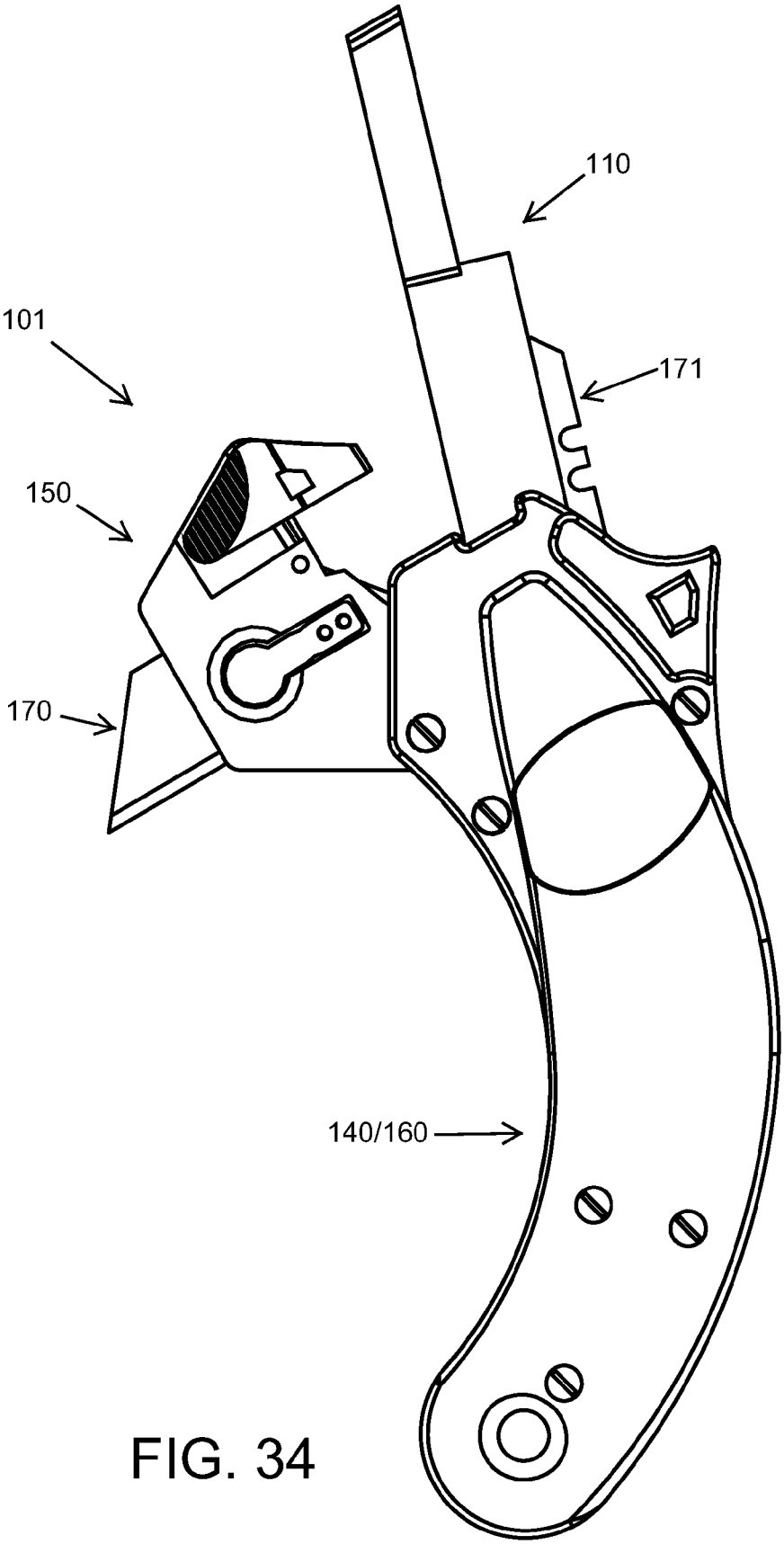
FIG. 34 is a side elevational view of a knife embodying said alternative embodiment, shown in partially assembled position having both a first blade and a second blade in position.

FIGS. 18A-18M provide more detail on how the three-sided blade plays a role in the preferred embodiment of the present invention. FIGS. 18A-C show how the knife blade previously described presents six portions, and how each portion can be presented from the knife handle by flipping or turning the blade within the blade retaining head. Each cutting portion is labeled by an portion label 90. A blade cutting portion indicator 91 distinguishes the cutting edge from the body of the blade. FIG. 18C shows the gap 51 located between two separate cutting portions 46. The gap can be a flat space, a notch, or it could be a continuous cutting edge. The purpose of the gap 51 is to designate between two separate cutting portions. FIGS. 18D-F show an alternative arrangement of the three-sided blade which includes a secondary ring of mounting holes 41 which provides additional stability to a blade secured by those holes in addition to the blade retaining hole 48. FIGS. 18G-J show how the cutting portion labeled "1" is presented initially when the blade is received by the blade receiving head 50. FIGS. 18K-M provide even more options for how the cutting portions of the three-sided blade may be presented.

III. Alternative Embodiment Utility Knife Apparatus 101

As shown in FIGS. 19-37, an alternative embodiment of the present invention includes a knife handle comprising a right portion 140 and a left portion 160, a knife blade 170 having a single cutting portion 104, a blade receiving head 150 for holding the blade in place, and a locking button pin 132 for locking the blade 170 into the blade receiving head 150. A number of securing or mounting bolts 102 are used to join the various elements together, including joining the right handle portion 140 to the left handle portion 160 through a variety of mounting bolt holes 106. A pivot bolt 103 inserted through a pivot bolt hole 118 of the handle portions pivotally mounts the blade receiving head 150 to the handle.

Each handle portion 140, 160 includes a recess 122 for providing grip control when using the knife. A hook area 112 is located along the top edge of each handle portion, the hook area including a locking notch 116 which engages with the latching catch 134 located on the blade receiving head 150, thereby locking the head in place between the two handle portions. The handle portions also include a knife hanging hole 124 which would allow a string or other structure to be looped through the hole for easy storage or transport of the assembled knife 101. Each handle portion 140, 160 includes a recess 154 for receiving the blade mounting head 150, and a recess 156 for receiving the flexible finger grip 128 which allows for the release of the latching catch 134, which thereby allows the receiving head 150 to pivot about the pivot bolt 103.

The blade receiving head 150 also includes a pivot hole 144 for receiving the pivot bolt 103 after passing through the right handle portion 140 pivot hole 118. This pivotally engages the blade receiving head with the handle portions. The blade 170 is inserted into a blade slot 142 located in the blade receiving head 150. The locking button pin 132 locks the blade in place by inserting the button 133 through the blade retaining hole 105 located in the blade, and the blade retaining hole 139 located in the opposite side of the blade retaining head 150. To switch which blade edge is active, the blade can be removed, flipped and turned, and reinserted to present a new blade. The locking button pin 132 is further secured in place to the blade receiving head by a pair of pegs 135 located on the top face of the blade receiving head. A blade positioning pin 137 ensures the blade is accurately lined up within the blade receiving head 150 using a pair of peg receptacles 141 to receive said pair of pegs 135.

Similar to the previous embodiment, a hook area 112 is located along the top edge of each handle portion, the hook area including a locking notch 116 which engages with the latching catch 134 located on the blade receiving head 150, thereby locking the head in place between the two handle portions. The blade receiving head 150 also includes a flex area 136 which allows inward movement of a finger squeeze grip element 128 which ultimately releases the latching catch 134 from the knife handle portions 140, 160 when the knife is assembled, thereby allowing the head to rotate away from the handle such that the blade can be turned or flipped, thereby presenting a new cutting portion.

Figure 35:
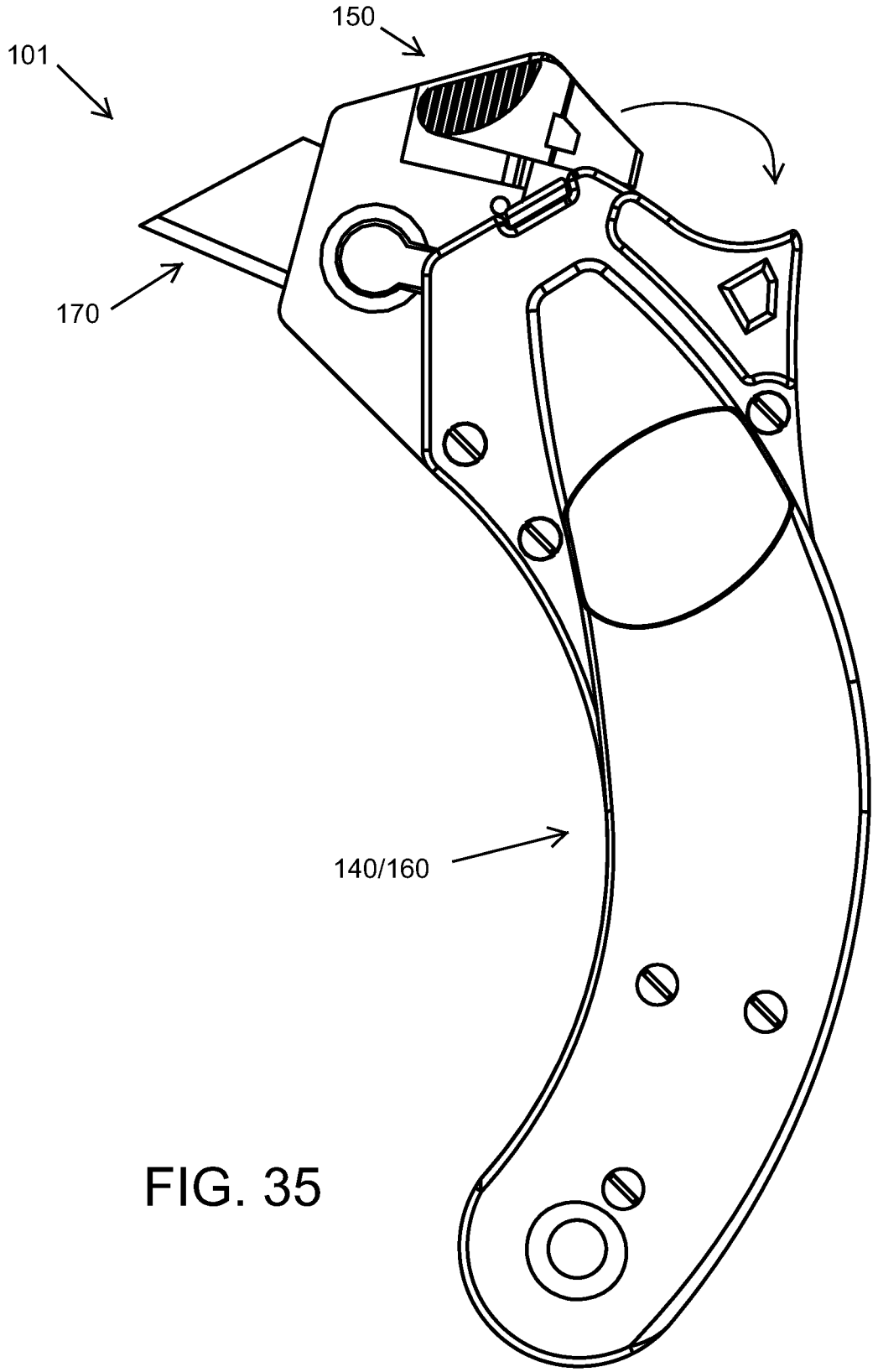
FIG. 35 is a side elevational view of a knife embodying said alternative embodiment, shown in an assembled position with the blade holder element rotating into position.
Figure 36:
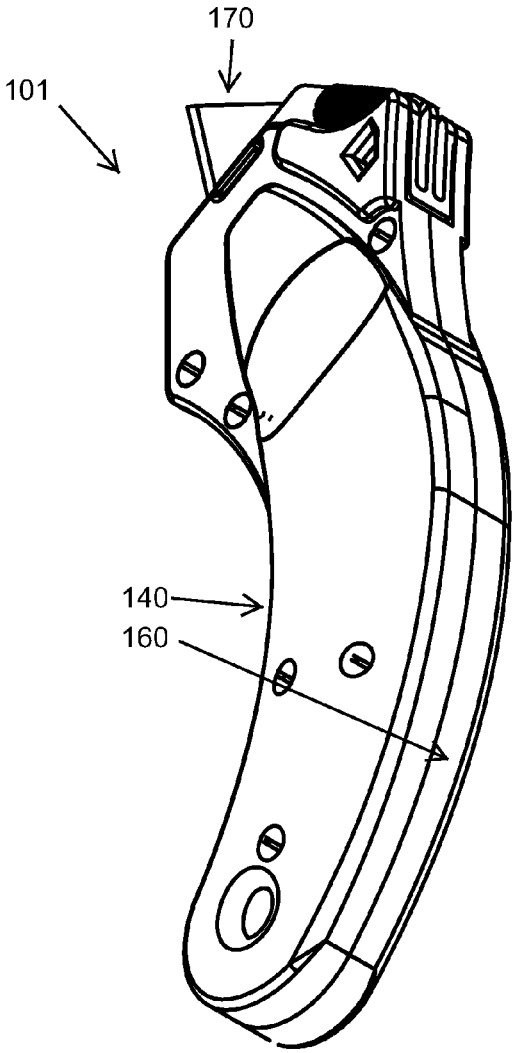
FIG. 36 is an isometric view of a knife embodying said alternative embodiment completely assembled.
Figure 37:
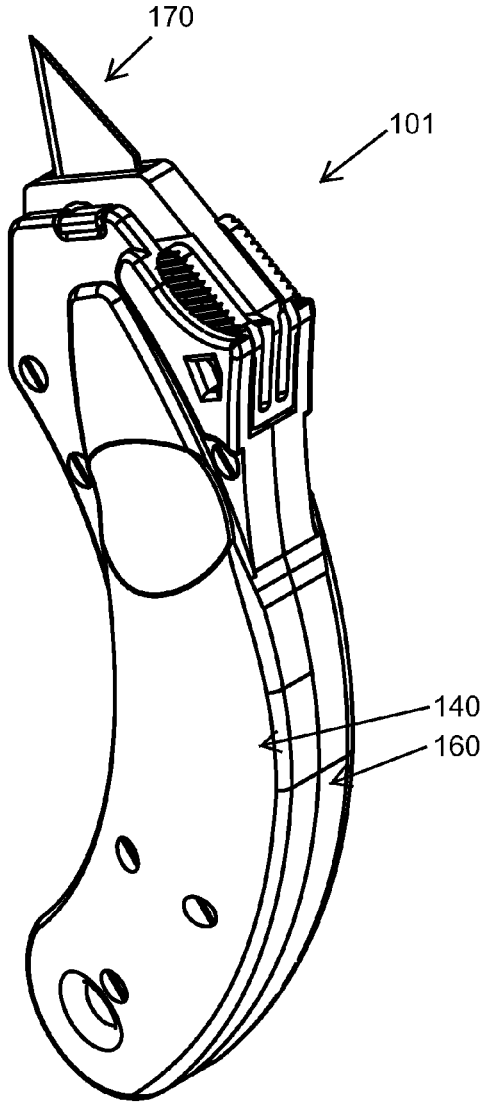
FIG. 37 is an alternative isometric view thereof.

The alternative embodiment knife 101 also includes a magazine clip 110 for holding a spare blade 171 within the blade handle portions 140, 160. This element is shown in more detail in FIGS. 29-32. The clip 110 includes a pair of flex finger grips 166 for squeezing the two halves of the clip together, which releases the latch lock 168 from a latch lock receiver 145. When the magazine clip 110 is fully inserted into a slide and containment area 164 located internally within the knife case, the clip is held in place by the latch locks 168 seated in the latch lock receivers 145. The forward section of the magazine clip 110 flexes, allowing the finger grips 166 to be squeezed inwardly, thus releasing the latch locks 168. The clip can then be pulled from the knife which exposes spare blades 171 for replacing the original blade 170. The magazine clip further includes two movement control pins 172 which permits movement of the clip while the clip is stored within the handle, while ensuring that the clip remains within the handle. The control pins 172 do allow the magazine 110 to be withdrawn from the handle portions 140, 160 far enough to remove a replacement blade, but the magazine is not allowed to be completely removed. When rotating the blade retaining head 150 to the closed position as shown in FIG. 35, the magazine 110 automatically snaps into a locked position.

Note also that the blade 170 can be flipped to expose a second cutting face along the same single cutting portion 104.

It is to be understood that while certain aspects of the disclosed subject matter have been shown and described, the disclosed subject matter is not limited thereto and encompasses various other embodiments and aspects.

The invention claimed is:

1. A knife comprising:

a disposable blade having multiple cutting portions and a positioning pin receiving hole;

a housing including a handle portion comprising a first half and a second half, wherein said first half is joined to said second half by a plurality of mounting bolts;

a head unit having a positioning pin receiving hole passing through a center of said head unit, and a pivot bolt receiver hole passing through near an edge of said head unit;

said head unit further including a blade receiver slot adapted for receiving said disposable knife blade such that only one of said multiple cutting portions is exposed from said housing;

a pivot bolt pivotally mounting said head unit to said housing between said first half and said second half, said pivot bolt received by said pivot bolt receiver hole;

a removable positioning pin locking said blade within said head unit via said blade positioning pin receiving hole and said head unit positioning pin receiving hole;

said head unit further including a grip button having a latch catch;

said head unit including a recessed space having a pair of pegs;

said positioning pin including a pair of peg receptacles;

wherein said positioning pin is received within said recessed space and said peg receptacles are adapted to secure said positioning pin on said pair of pegs; and said housing including a locking notch adapted for releasably receiving said latch catch, thereby preventing rotation of said head unit about said pivot bolt when said locking notch is engaged with said latch catch, and allowing rotation of said head unit when said locking notch releases said latch catch.

2. The knife of claim 1, further comprising:

said blade having a planar body with two distinct points, each said point facing a direction 180 degrees from the other respective point; and said blade having two cutting portions located along the same side of said blade, each said cutting portion culminating into one of said two points.

3. The knife of claim 2, further comprising:

a magazine clip having a rectangular lower body including a top wall, a bottom wall, two side walls, and a back wall, wherein said top, bottom, back, and sidewalls define a storage space having an opening;

said magazine clip further including a pair of upstanding arms each culminating in a grip, said arms being capable of flexing;

a pair of locking receivers;

each said upstanding arm including a latch lock capable of engagement with a respective one of said locking receivers; and at least one replacement blade contained within said storage space, said replacement blade having the same features as said blade.

4. The knife of claim 1, wherein each of said first and second halves of said housing include a grip recess area.

5. The knife of claim 1, wherein each of said first and second halves of said housing include a hanging hole, said hanging hole of said first half aligned with said hanging hole of said second half, such that said hanging holes form an opening running through said housing.

* * * * *